US009311904B2

(12) United States Patent
Nakajima

(10) Patent No.: US 9,311,904 B2
(45) Date of Patent: Apr. 12, 2016

(54) WOODWIND INSTRUMENT AND AIRFLOW ADJUSTER

(75) Inventor: Hiroshi Nakajima, Hamamatsu-Shi (JP)

(73) Assignee: Yamaha Corporation, Hamamatsu (JP)

( * ) Notice: Subject to any disclaimer, the term of this patent is extended or adjusted under 35 U.S.C. 154(b) by 428 days.

(21) Appl. No.: 13/455,343

(22) Filed: Apr. 25, 2012

(65) Prior Publication Data

US 2012/0272809 A1 Nov. 1, 2012

(30) Foreign Application Priority Data

Apr. 28, 2011 (JP) ..... 2011-101048

(51) Int. Cl.
*G10D 9/04* (2006.01)

(52) U.S. Cl.
CPC ..... *G10D 9/043* (2013.01)

(58) Field of Classification Search
CPC ..... G10D 7/026; G10D 9/00; G10D 9/04; G10D 7/00; G10D 7/04; G10G 5/00; G10G 5/005; G10K 5/00
USPC ..... 84/380 R, 386, 385 A, 396
See application file for complete search history.

(56) References Cited

U.S. PATENT DOCUMENTS

| | | | | | |
|---|---|---|---|---|---|
| 1,409,180 | A | | 3/1922 | Humes | |
| 2,226,536 | A | | 12/1940 | Selmer | |
| 4,714,001 | A | * | 12/1987 | Kergomard et al. | 84/386 |
| 5,241,890 | A | | 9/1993 | Galper | |
| 5,885,126 | A | * | 3/1999 | Carlson | 446/208 |
| 6,124,537 | A | | 9/2000 | de Lancie | |
| 8,314,318 | B2 | * | 11/2012 | Brockman | 84/386 |
| 8,469,765 | B2 | * | 6/2013 | Nolz et al. | 446/202 |

FOREIGN PATENT DOCUMENTS

| | | | | | |
|---|---|---|---|---|---|
| CN | 2067446 | U | | 12/1990 | |
| CN | 1287344 | A | | 3/2001 | |
| CN | 2658894 | Y | | 11/2004 | |
| CN | 202210405 | U | * | 2/2012 | G10D 7/02 |
| DE | 4306990 | A1 | | 9/1993 | |
| DE | 202007011198 | U1 | | 10/2007 | |
| FR | 2584222 | A1 | | 1/1987 | |
| FR | CN202210405 | U | * | 5/2012 | 84/380 R |
| JP | A-57-002090 | | | 1/1982 | |
| JP | 01-158491 | A | | 6/1989 | |
| JP | A-07-325567 | | | 12/1995 | |
| JP | A-09-269771 | | | 10/1997 | |
| WO | WO-2010/068909 | A2 | | 6/2010 | |

OTHER PUBLICATIONS

European Search Report issued for corresponding EP Appll No. 12 16 5679, mail date Jul. 12, 2012.

(Continued)

*Primary Examiner* — Kimberly Lockett
(74) *Attorney, Agent, or Firm* — Blank Rome LLP

(57) ABSTRACT

A woodwind instrument such as a clarinet includes a main tube including an upper tube and a lower tube and a correcting tone hole used solely for interval correction is formed in the lower tube. An airflow adjuster is installed in the correcting tone hole. The airflow adjuster is formed in an M shape by bending a film member at three positions. The airflow adjuster can properly arrange a turbulent airflow in the correction tone hole during performance and can reduce undesired sound generated from the correcting tone hole.

14 Claims, 4 Drawing Sheets

(56) References Cited

OTHER PUBLICATIONS

Chinese Office Action issued for CN 201210124864.5, mail date Dec. 23, 2013, English translation of Search Report only.

JP Office Action dated Sep. 1, 2015 from JP Application No. 2011-101-48.

Office Action from JP Application 2011-101048 issued Jan. 20, 2015.

* cited by examiner

WOODWIND INSTRUMENT AND AIRFLOW ADJUSTER

INCORPORATED BY REFERENCE

Priority is claimed on Japanese Patent Application No. 2011-101048, filed Apr. 28, 2011, the content of which is incorporated herein by reference.

BACKGROUND OF THE INVENTION

1. Field of the Invention

The present invention relates to a woodwind instrument and an airflow adjuster, and more particularly, to a woodwind instrument and an airflow adjuster which can reduce undesired sound generated from a tone hole.

2. Description of Related Art

Woodwind instruments such as a clarinet described in Japanese Unexamined Patent Application, First Publication No. H01-158491 have been widely used. In a clarinet, a bell is coupled to a lower tube of a main tube formed from an upper tube and a lower tube. Tone holes are formed in the main tube at predetermined intervals along the axis line direction thereof. By closing and opening these tone holes, the effective length of the tube is changed to perform specific tones. Each tone hole is opened and closed through the use of a key with a pad or the like by manipulating the key with a finger tip. Here, a clarinet having an interval-correcting tone hole formed in a bell part thereof so as to correct the interval of a low-pitched tone (LowE) is known.

However, in the clarinet in which the interval is corrected as described above, since a tone hole is formed in the bell part independently of the tone holes formed in the main tube, there is a problem in that the number of components increases and the adjustment of the keys located in the lower tube and the bell part is complicated. Since the number of components increases, there is a problem in that the work load for adjusting the clearances between the components increases and the manufacturing cost thereof also increases. In addition, when a user combines the bell part with the lower tube, there is a problem in that the keys located therein may collide and bend or the like and thus the keys may be damaged. Therefore, it can be thought that in order to solve the above-mentioned problems, the interval-correcting tone hole could be formed in the lower tube. In this case, there is a problem in that in order to achieve the equivalent interval correction effect, the tone hole should be formed with a hole diameter smaller than that of the tone hole formed in the bell part and this creates undesired sound as wind noise (sound such as hissing noise) from the tone hole during performance. Here, Related Arts 1 to 3 described below can be considered as techniques for suppressing the generation of undesired sound while forming an interval-correcting tone hole in the lower tube.

[Related Art 1]

The hole diameter of the interval-correcting tone hole is set to be greater than the hole diameter of the other tone holes used for the musical performance.

[Related Art 2]

The gap between the interval-correcting tone hole and the key with a pad at an open position at which the tone hole is opened and closed, that is, the pad opening at the interval-correcting tone hole, is set to be as large as possible.

[Related Art 3]

The axis line direction of the interval-correcting tone hole is oblique about the diameter direction of the lower tube and air flowing out of the tone hole is made not to come in contact with the open key with a pad.

However, in Related Art 1, when the hole diameter of the interval-correcting tone hole is increased so as to further reduce undesired sound, the distance of an arm connecting the pad plate to a key tube decreases by the amount by which a pad plate is enlarged. Accordingly, there is a problem in that the stroke of a key with a pad is insufficient, thereby making the performance difficult. Here, it is possible to enlarge the pad opening to satisfactorily guarantee the stroke. However, in this case, the fingering distance increases, and if an effort to reduce the fingering distance by changing the leverage ratio is made, performance is made more difficult by a spring being heavier or the like. In Related Art 2, since the pad opening is enlarged, performance is also difficult as described above.

In Related Art 3, since the tone holes other than the interval-correcting tone hole are formed by drilling the main tube in the diameter direction thereof, it is necessary to separately prepare a machine solely for machining the interval-correcting tone hole. That is, a machining shaft for the interval-correcting tone hole should be added, whereby a facility load of a high-function machine tool corresponding thereto increases.

SUMMARY OF THE INVENTION

An object of the invention is to provide a woodwind instrument and an airflow adjuster in which the hole diameter of a tone hole can be set to be smaller and the generation of undesired sound can be reduced.

Another object of the invention is to provide a woodwind instrument and an airflow adjuster in which the number of components or the manufacturing cost thereof can be reduced and the performance thereof can be prevented from becoming difficult.

To achieve the above-mentioned objects, according to an aspect of the invention, there is provided a woodwind instrument including an airflow adjuster that is installed in a tone hole formed in a tube.

In the woodwind instrument, the tube may include an upper tube and a lower tube and the tone hole having the airflow adjuster installed therein may be formed in the lower tube.

In the woodwind instrument, the tone hole having the airflow adjuster installed therein may be a tone hole used only for interval correction.

In the woodwind instrument, the airflow adjuster may be formed by bending a film member at plural positions.

In the woodwind instrument, a stepped portion may be formed in the inner circumferential surface of the tone hole and the airflow adjuster may be made to engage with the stepped surface.

According to another aspect of the invention, there is provided an airflow adjuster that is installed to be inserted into a tone hole formed in a tube of a woodwind instrument.

According to the invention, since the airflow adjuster is installed in the tone hole, it is possible to properly arrange a turbulent airflow in the tone hole during the performance as described later and to reduce undesired sound generated from the tone hole while reducing the hole diameter. Accordingly, when the woodwind instrument is a clarinet, it is possible to form an interval-correcting tone hole in the lower tube, to reduce the number of components, to reduce the working load such as the adjustment work of keys, and to suppress an increase in manufacturing cost. Since the hole diameter of the tone hole having the airflow adjuster installed therein can be reduced, it is possible to avoid the insufficient stroke of a key with a pad described in the related art or the increase in fingering distance and thus to prevent the performance from becoming difficult. It is possible to form the interval-correcting tone hole and the other tone holes using machining methods and machining facilities of the related art and thus to suppress an increase in facility load.

When the airflow adjuster is formed by bending a film member at a plurality of positions, it is possible to make the structure very simple and to easily suppress the generation of undesired sound. In addition, using the elasticity of the airflow adjuster, the airflow adjuster is deformable to be able to stretch and contract in the diameter direction of the tone hole and can be easily attached to the tone hole for a short time by pressing the airflow adjuster to the inner circumferential surface of the tone hole so as to be supported therein.

When the stepped portion is formed on the inner circumferential surface of the tone hole and the airflow adjuster is made to engage with the stepped portion, it is possible to regulate the displacement of the airflow adjuster in the tone hole and thus to prevent the airflow adjuster from accidentally falling out of the tone hole.

DETAILED DESCRIPTION OF THE INVENTION

Hereinafter, exemplary embodiments of the invention will be described with reference to the accompanying drawings.

In the following description, as long as not otherwise specified, the terms, "up" and "down", mean upward and downward in paper surface of FIG. 1A. That is, a mouthpiece of a woodwind instrument is located at an upper position and a bell part is located at a lower position.

Figure 1A:
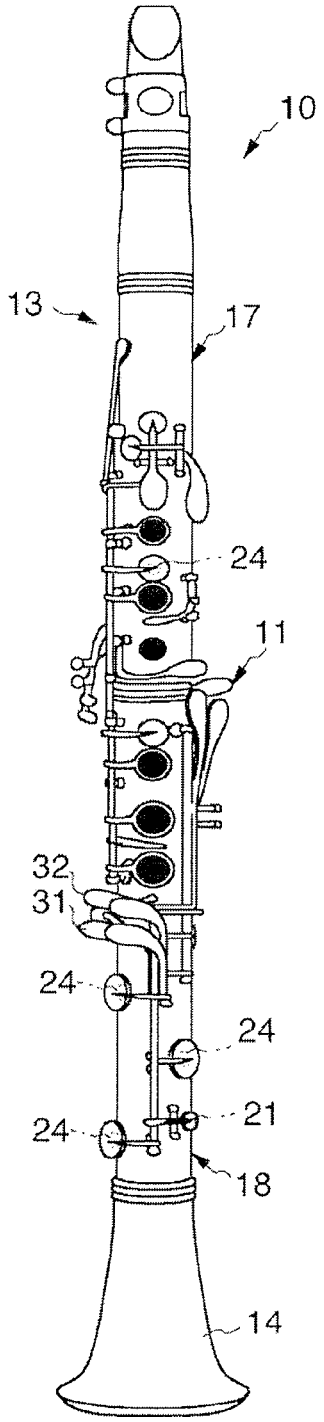
FIG. 1A is a front view illustrating a woodwind instrument according to an embodiment of the invention.
Figure 1B:
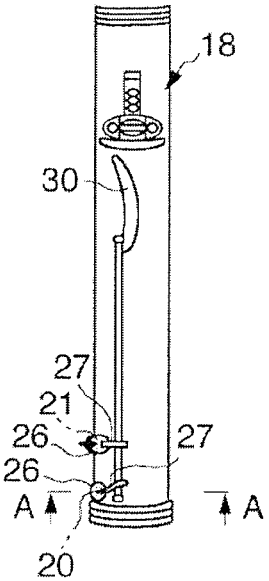
FIG. 1B is a partial rear view illustrating the woodwind instrument shown in FIG. 1A.

Referring to FIGS. 1A and 1B, a woodwind instrument 10 is a Boehm B-flat clarinet in this embodiment. The woodwind instrument 10 includes a main tube 13 which is a tube having keys 11 arranged on the outer circumferential surface thereof and a bell part 14 which is connected to a lower tube of the main tube 13. The main tube 13 includes an upper tube 17 and a lower tube 18 coupled to each other. A plurality of tone holes 20, 21, and 24 are formed in the upper tube 17 and the lower tube 18. Keys 11 and 26 are disposed in a plurality of tone holes so as to open and close the tone holes. Among these tone holes, two tone holes 20 and 21 are tone holes (hereinafter, referred to as "correcting tone holes 20 and 21") disposed solely for interval correction. The other tone holes 24 are tone holes which are opened and closed to switch the interval of the clarinet. In this embodiment, no tone hole is formed in the bell part 14.

The lower correcting tone hole 20 is opened to correct the interval of a lowest-pitched tone (Low E) which is generated by closing all the tone holes 24. The upper correcting tone hole 21 is opened at the same time as opening the lower correcting tone hole 20, thereby correcting the interval of the tone (Low F) higher a half step than Low E. By opening the correcting tone holes 20 and 21, the corrected interval can be increased by 10 to 20 cents.

Figure 2A:
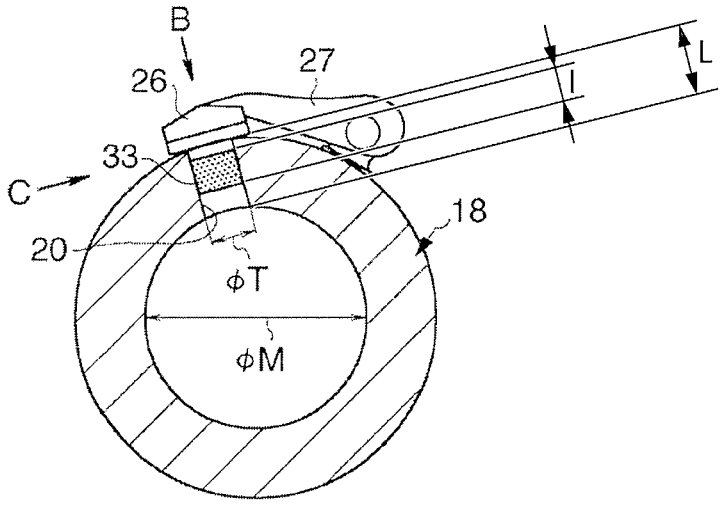
FIG. 2A is a sectional view taken along line A-A of the woodwind instrument shown in FIG. 1B.

The correcting tone holes 20 and 21 are opened and closed by keys with a pad 26, as shown in FIG. 2A. These keys with a pad 26 are connected to an arm 27. When performing the lowest-pitched tone (LowE), a player presses a Low E/F tone correcting key 30 at the same time as pressing a LowE/B key 31 (see FIG. 1A). Accordingly, the arm 27 rotates to make the key with a pad 26 come apart from the outer circumferential surface of the lower tube 18, whereby the correcting tone hole 20 is opened. When performing the tone (Low F) higher a half step than the lowest-pitched tone, the player presses the Low E/F interval correcting key 30 at the same time as pressing a Low F/C key 32 (see FIG. 1A), thereby opening the correcting tone holes 20 and 21. In each of the correcting tone holes 20 and 21, the axis line direction of the corresponding tone hole is parallel to the diameter direction of the lower tube 18.

As shown in FIG. 2A, an airflow adjuster 33 is installed in the lower correcting tone hole 20.

Figure 2B:
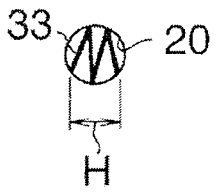
FIG. 2B is a rear view of a tone hole of the woodwind instrument shown in FIG. 2A when seen in the direction of B.
Figure 2C:
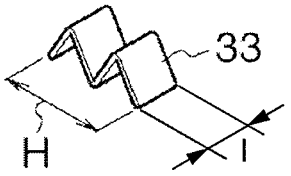
FIG. 2C is a perspective view illustrating an airflow adjuster according to an embodiment of the invention.

As shown in FIGS. 2B and 2C, the airflow adjuster 33 is formed in an M shape by bending a band-like film member formed of a resin material such as polyester at plural positions. The airflow adjuster 33 is installed at the position and with the size shown in FIG. 2A. Specifically, the airflow adjuster 33 is located in a middle part in the axis line direction of the tone hole 20 so as not to protrude from both opening ends of the correcting tone hole 20. The airflow adjuster 33 is attached to the tone hole 20 so that plural planes formed by the bending are parallel to the axis line of the tone hole 20. The length (the thickness of the lower tube 18) L of the tone hole 20 is 6.2 mm and the length l of the airflow adjuster 33 is 2.8 mm. The airflow adjuster 33 is disposed so as to be invisible when seen from the end section side of the tone hole 20 (the direction of arrow C in FIG. 2A).

Since the airflow adjuster 33 is formed in a zigzagged M shape, it is deformable so as to be able to expand and contract in size in the width H direction in FIG. 2C. Accordingly, the airflow adjuster 33 can be made into a folded state by picking up the airflow adjuster 33 from the width H direction by the use of a pair of forceps or the like and can be inserted into the correcting tone hole 20 in this state. When the pinching of the airflow adjuster 33 by the pair of forceps is released, the airflow adjuster 33 returns easily to the original shape due to the elastic force of the material and thus the magnitude of the width H increases. Accordingly, both ends of the airflow adjuster 33 can be strongly pressed against the inner circumferential surface of the correcting tone hole 20 and the position of the airflow adjuster 33 in the correcting tone hole 20 is thus determined. The diameter $\phi T$ of the tone hole 20 is 3.5 mm. Accordingly, when the airflow adjuster 33 is attached to the tone hole 20 (the state shown in FIG. 2B), the width H is slightly smaller than 3.5 mm.

Figure 3A:
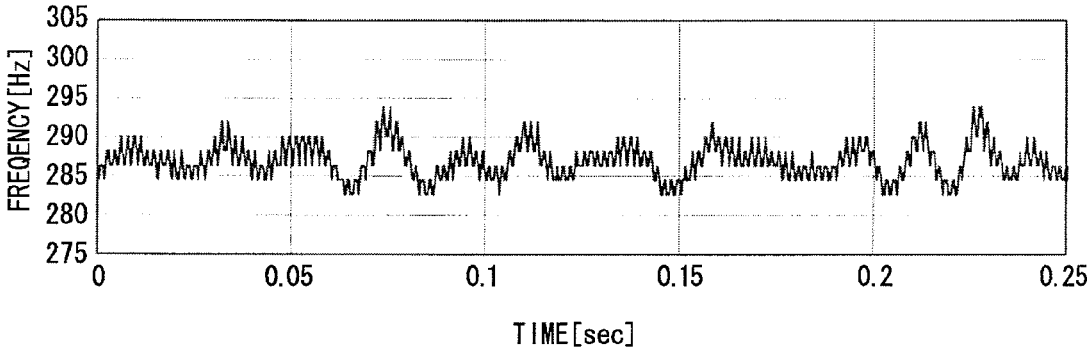
FIGS. 3A, 3B, and 3C are graphs illustrating a periodic variation of a second partial tone during performance of a lowest-pitched tone in the woodwind instruments according to the related art and the embodiment of the invention.
Figure 3B:
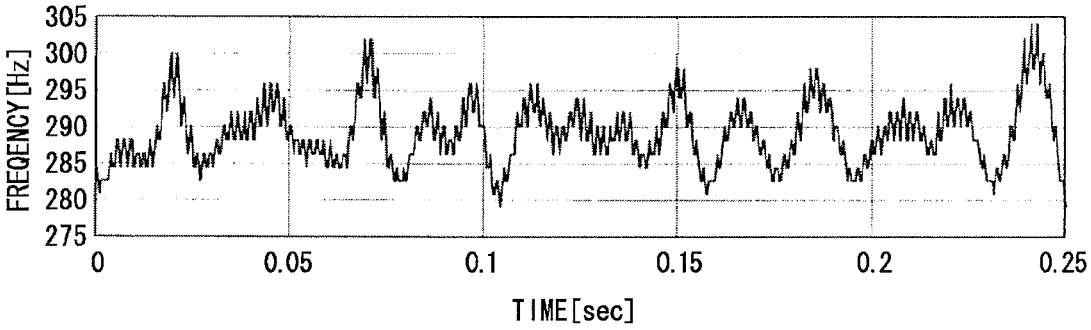
Figure 3C:
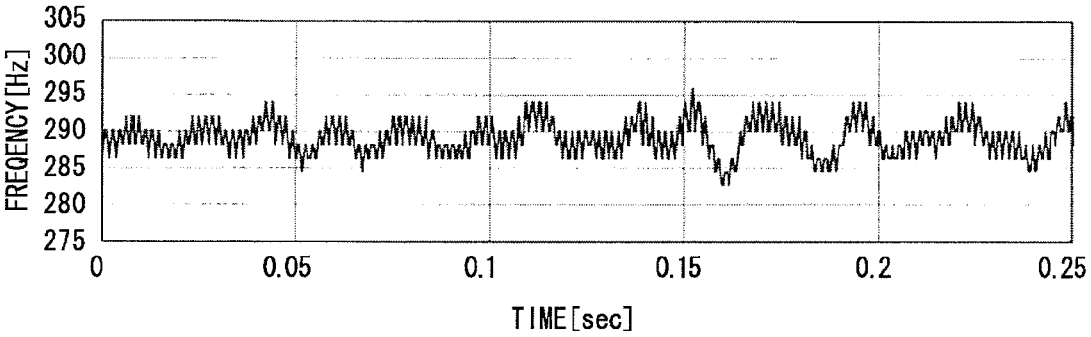

In the woodwind instrument 10 according to this embodiment, the results of measurement and comparison of a periodic variation of a second partial tone (double overtone) when performing the lowest-pitched tone (musical notation E, actual sound D) are shown in FIGS. 3A to 3C. FIGS. 3A and 3B show the periodic variation in a comparative example. The graph of FIG. 3A shows the periodic variation measured when the correcting tone hole 20 is closed by the key with a pad 26 and the graph of FIG. 3B shows the periodic variation measured when the correcting tone hole 20 is opened without installing the airflow adjuster 33 in the correcting tone hole 20. FIG. 3C shows the periodic variation in this embodiment. The graph of FIG. 3C shows periodic variation measured when the correcting tone hole 20 is opened with the airflow adjuster 33 installed in the correcting tone hole 20.

In the graph of FIG. 3A (where the tone hole 20 is closed), the average frequency is several Hz lower than a desired interval (a frequency of 293.7 Hz), but the variation in frequency is small and the amount of undesired sound is small. In the graph of FIG. 3B (where the tone hole 20 is opened and the airflow adjuster 33 is not installed), the average frequency is close to the desired interval (a frequency of 293.7 Hz), but the variation in frequency is great and distorted noise is recognized from the performed tone. In the graph of FIG. 3C (where the tone hole 20 is opened and the airflow adjuster 33 is installed), the average frequency is the desired interval (a frequency of 293.7 Hz), the interval is musically correct, the variation in frequency is small, and there is little undesired sound. Therefore, according this embodiment, it is possible to excellently correct the interval of the lowest-pitched tone and to suppress the generation of undesired sound, compared with the comparative examples.

In addition, significant variations in frequency like those in the graph are not acceptable in the fundamental tone and the third to tenth partial tones during performance. The clarinet is basically configured to generate only odd overtones, but the second partial tone actually has a sound pressure level of about −30 dB with respect to the fundamental tone component, which is sufficiently perceivable. It is understood that the reason is that the second partial tone is generated due to the air disturbance caused secondarily in a half period in which air particles move from the inside of the instrument to the outside via the tone hole in a period of air-column resonant vibration and a half period in which air particles move from the outside of the tone hole to the inside of the instrument. Therefore, the perception of the second partial tone is different in principle from a wind noise generating mechanism due to the disturbance of a fast continuous fluidized airflow.

Measurement using PIV (Particle Image Velocimetry) in the woodwind instrument 10 will be described below.

PIV-specific lubricant particles (DOS) of about 1 micron are transported into the main tube 13 along with air from the mouthpiece, a laser beam is set to be vertical or horizontal in a simple box covered with a blackout curtain, the velocity of particles in the main body 13 or in the vicinity of the tone holes 20 and 24 during the resonance of a lowest-pitched tone in which the lowest-pitched tone is blown with an automatic blowing device is measured. The flow rate in the vicinity of the correcting tone hole 20 and the flow rate in the vicinity of the tone hole 24 close to the location of the correcting tone hole 20 are measured and compared with each other. The flow rates when the airflow adjuster 33 is inserted into the correcting tone hole 20 and when the airflow adjuster 33 is not inserted are measured and compared with each other. As a result, it can be seen that the flow of air in the vicinity of the tone hole 24 is different from the flow of air in the vicinity of the correcting tone hole 20. In the tone hole 24, since the diameter is greater than that of the correcting tone hole 20, it can be seen that the flow rate from the outside to the inside of the lower tube 18 and the flow rate from the inside to the outside of the lower tube 18 are both small, and there is no great difference between the flows of air on the right and left sides of FIGS. 1A and 1B with respect to the vertical direction. On the contrary, regarding the flow of air in the vicinity of the correcting tone hole 20, it is thought that the flow rate from the outside to the inside of the lower tube 18 and the flow rate from the inside to the outside of the lower tube 18 are relatively great and this serves as a factor for generating undesired sound. In addition, in the correcting tone hole 20, the flow of air suctioned from the outside to the inside of the lower tube 18 is set to the vertical direction and the flow of air erupted from the inside to the outside of the lower tube 18 is set to the horizontal direction, but the flow rates of both the eruption of an airflow to the outside and the suction of an airflow to the inside are suppressed by installing the airflow adjuster 33 in the correcting tone hole 20. Particularly, at the time of eruption from the inside to the outside of the lower tube 18, it can be seen that the flow of air around the correcting tone hole 20 is uniform across the entire periphery. Therefore, regarding the flow of air around the correcting tone hole 20, it is thought that a difference in the flow of air between the vertical direction and the horizontal direction does not occur when the airflow adjuster 33 which limits the boundary conditions of an airflow pressure distribution inserted therein, and thus undesired sound is reduced.

The range of hole diameters with which the correcting tone holes 20 and 21 can be used as interval-correcting tone holes, the airflow adjuster 33 is inserted into the tone holes, and the effect of a reduction in undesired sound expected can be set to the range of $0.1 \leq \phi T/\phi M \leq 0.5$, where $\phi M$ represents the inner diameter of the lower tube 18, $\phi T$ represents the hole diameter of the correcting tone holes 20 and 21, and $\phi T/\phi M = 3.5/18.77 = 0.19$ is set in this embodiment. The effective range of the vertical position of the correcting tone hole 20 is when the center position is within 23.0 mm above from the boundary position (from the lower end surface of the lower tube 18) between the lower tube 18 and the bell part 14. The ratio (l/L) of the length l of the airflow adjuster 33 to the length (the thickness of the lower tube 18) L of the tone hole 20 in this embodiment is $l/L = 2.8/6.2 = 0.45$. The length l of the airflow adjuster 33 is preferably selected so that the ratio l/L is equal to or less than 0.9. The ratio ($l/\phi T$) of the length l of the airflow adjuster 33 to the diameter $\phi T$ of the tone hole 20 is $l/\phi T = 2.8/3.5 = 0.80$. This ratio $l/\phi T$ is preferably selected to be equal to or more than 0.2. That is, the length l of the airflow adjuster 33 is in the range of $0.2\phi T \leq l \leq 0.9L$.

According to this embodiment, the hole diameter of the correcting tone hole 20 formed in the lower tube 18 can be set to be smaller than the hole diameter of the tone holes 24 and thus the reduction of undesired sound generated from the correcting tone hole 20 can be achieved. Accordingly, it is possible to reduce the number of components and to reduce the load such as the adjustment of keys to achieve a decrease in cost, compared with the related art in which the correcting tone hole is formed in the bell part 14. In addition, since the hole diameter of the correcting tone hole 20 decreases, it is possible to avoid an insufficient stroke of the key with a pad 26 or an increase in fingering distance and to prevent the performance from becoming difficult.

As described above, the structure and method for putting the invention into practice are mentioned above, but the invention is not limited to the constitution and method.

Figure 4:
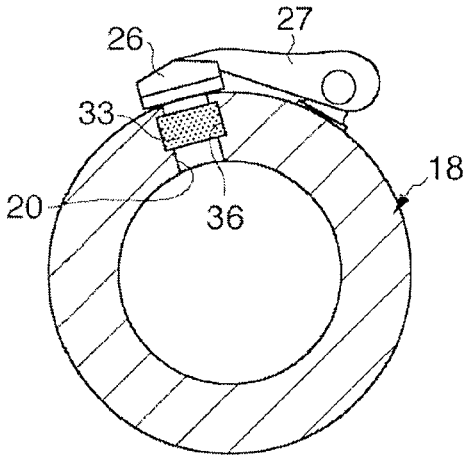
FIG. 4 is a sectional view illustrating a woodwind instrument according to another embodiment of the invention.

The shape of the correcting tone hole 20 can be modified in various manners and, for example, the constitution shown in FIG. 4 may be employed. In FIG. 4, the correcting tone hole 20 includes a large-diameter portion 36 formed by partially increasing the diameter of an intermediate portion in the axis line direction in the inner circumferential surface thereof and the airflow adjuster 33 can be attached to the large-diameter portion 36. Accordingly, the airflow adjuster 33 can engage with the step-formed surface of the large-diameter portion 36, thereby preventing the airflow adjuster 33 from accidentally falling out of the correcting tone hole 20.

An adhesive may be applied to the airflow adjuster 33 in advance and then the airflow adjuster 33 may be inserted into the correcting tone hole 20. Accordingly, the airflow adjuster 33 is strongly fixed into the tone hole 20, thereby preventing the airflow adjuster 33 from rotating in the circumferential direction of the correcting tone hole 20.

The airflow adjuster 33 is not limited to the above-mentioned M shape, but may be formed in shapes such as V, N, and W by bending the film member at one or more positions, or may be formed to have a region connected to the shapes and parallel to the inner circumferential surface of the correcting tone hole 20. A plurality of sheet members may be combined to form the airflow adjuster having a cross shape or a lattice shape. The airflow adjuster may also be a spiral shape. The orientation of the circumferential direction of the correcting tone hole 20 in which the airflow adjuster 33 is located is not limited to the trend shown in the drawing, but may be appropriately changed.

The airflow adjuster 33 may be formed of paper or a thin metal plate. The airflow adjuster 33 is not limited to the band-like shape and a porous member (such as a foamed resin or a pumiceous member) may be inserted into the correcting tone hole 20.

The airflow adjuster according to the invention may be applied to clarinets other than the Boehm B-flat clarinet or to other woodwind instruments.

While the invention has been drawn and described with reference to a specific embodiment, the above-mentioned embodiment may be modified in various forms in shape, position, or arrangement by those skilled in the art without departing from the technical concept and object of the invention.

Therefore, the above description defining the shape or the like is intended to facilitate the understanding of the invention, but is not intended to limit the invention. Accordingly, the invention is defined only by the appended claims and includes members departing from a part or all of the definitions of the shapes or the like.

While preferred embodiments of the invention have been described and illustrated above, it should be understood that these are exemplary embodiments of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A woodwind instrument comprising:
a tube having a plurality of tone holes; and
an airflow adjuster statically disposed in a selected tone hole of the plurality of the tone holes,
wherein the airflow adjuster is a film member bent at a plurality of positions.

2. An airflow adjuster comprising a bent film member configured to be inserted into a tone hole in a tube of a woodwind instrument, wherein the bent film member comprises a plurality of planes.

3. The airflow adjuster according to claim 2, wherein each of the plurality of planes is parallel to an axis line of the tone hole.

4. The airflow adjuster according to claim 2, wherein the airflow adjuster has a height less than a corresponding height of the tone hole.

5. An airflow adjuster comprising a bent film member configured to be inserted into a tone hole in a tube of a woodwind instrument, wherein the bent film member is deformable.

6. A woodwind instrument comprising:
a tube having a plurality of tone holes; and
an airflow adjuster disposed in a selected tone hole of the plurality of tone holes,
wherein the airflow adjuster is a film member bent at a plurality of positions.

7. The woodwind instrument according to claim 6, wherein the film member comprises a plurality of planes.

8. The woodwind instrument according to claim 7, wherein each of the plurality of planes is parallel to an axis line of the selected tone hole.

9. The woodwind instrument according to claim 6, wherein the airflow adjuster has a height less than a corresponding height of the selected tone hole.

10. The woodwind instrument according to claim 6, wherein the bent film member is deformable.

11. A woodwind instrument comprising:
a tube having a plurality of tone holes; and
an airflow adjuster disposed in a selected tone hole of the plurality of tone holes,
wherein the selected tone hole comprises a stepped inner surface and the airflow adjuster is configured to engage with the stepped inner surface,
wherein the airflow adjuster is a bent film member comprising a plurality of planes.

12. The woodwind instrument according to claim 11, wherein each of the plurality of planes is parallel to an axis line of the selected tone hole.

13. The woodwind instrument according to claim 11, wherein the bent film member is deformable.

14. A woodwind instrument comprising:
a tube having a plurality of tone holes; and
an airflow adjuster disposed in a selected tone hole of the plurality of tone holes,
wherein the selected tone hole comprises a stepped inner surface and the airflow adjuster is configured to engage with the stepped inner surface,
wherein the airflow adjuster has a height less than a corresponding height of the selected tone hole.

* * * * *